US006682384B2

(12) United States Patent
Wang

(10) Patent No.: US 6,682,384 B2
(45) Date of Patent: Jan. 27, 2004

(54) GLOWING THROW DEVICE

(76) Inventor: Grace Wang, 2090 Del Rio Pl., Ontario, CA (US) 91761

( * ) Notice: Subject to any disclaimer, the term of this patent is extended or adjusted under 35 U.S.C. 154(b) by 0 days.

(21) Appl. No.: 10/113,228

(22) Filed: Mar. 29, 2002

(65) Prior Publication Data

US 2003/0186615 A1 Oct. 2, 2003

(51) Int. Cl.[7] ..... A63H 27/00; A63H 33/22
(52) U.S. Cl. ..... 446/46; 446/219
(58) Field of Search ..... 446/46, 47, 48, 446/219, 485, 175, 236, 242, 484

(56) References Cited

U.S. PATENT DOCUMENTS 3,359,000 A * 12/1967 Schreiber ..... 446/46
3,576,987 A * 5/1971 Voight et al. ..... 362/34
4,086,723 A * 5/1978 Strawick ..... 446/47
4,204,357 A * 5/1980 Harrington ..... 446/47
4,207,702 A * 6/1980 Boatman et al. ..... 446/48
4,254,575 A * 3/1981 Gould ..... 446/46
4,944,707 A * 7/1990 Silverglate ..... 446/48
5,261,846 A * 11/1993 Hanna ..... 446/46
5,536,195 A * 7/1996 Stamos ..... 446/48

OTHER PUBLICATIONS

US 2002/0034918, Komuro, Revolving and Flying toy, Mar. 21, 2002.*
Glow Frisbee, 2002, The GlowSpace.*

* cited by examiner

*Primary Examiner*—Jacob K. Ackun
*Assistant Examiner*—Faye Francis
(74) *Attorney, Agent, or Firm*—Boniard I. Brown

(57) ABSTRACT

A glow throw loop has a closed, preferably spring-like loop with a flexible web mounted on and extending across the loop. A glow ring with glow material therein is attached to and coextensive with the loop.

24 Claims, 2 Drawing Sheets

GLOWING THROW DEVICE

BACKGROUND AND SUMMARY OF THE INVENTION

The present invention provides a glow or toss loop comprising a loop, preferably having a spring characteristic, a flexible web attached about and extending across the loop, and a glow ring attached to the loop and extending about the loop. The ring is disposed in a peripheral hem of the web, and the glow ring is attached or retained by a plurality of rings secured at the hem through which the glow ring extends. The loop is enclosed in the peripheral hem of the web, with the glow ring retained at the hem.

Throw or toss loops have long been well known.

The present invention provides additional enjoyment and appreciation of throw loops by providing throw loops which provide attractive and entertaining glow and light effects when tossed and flying through the air, particularly during evening or night hours.

DESCRIPTION OF THE PREFERRED EMBODIMENT

Figure 1:
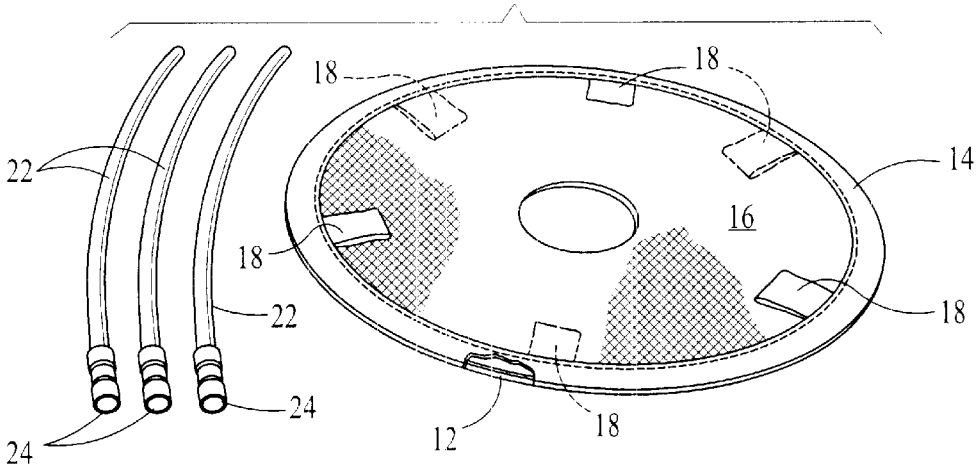
FIG. 1 is a perspective view of a throw disk of the invention, and a plurality of tubular segments of glow material.

Referring to the drawings, a preferred embodiment of the present invention 10 is shown as comprising a wire loop 12 of spring steel or appropriate plastic with a spring characteristic, enclosed in a hem 14 of a web 16 which extends across the wire loop, as shown. The web and peripheral hem 14 may typically be formed of a fabric such as nylon, plastic-coated fabric, or other appropriate material. A plurality of retaining rings 18, preferably of the fabric of the web or an appropriate plastic, loosely attaches a glow ring 20 disposed in and adjacent to and coextensive with the loop 12.

The glow ring comprises a plurality of segments 22, typically three segments, each containing a glow material. The glow segments are attached together by joint members 24 to form a continuous ring, facilitated by sockets defined in their end portions, to receive and secure end portions of the respective segments, thus to form the glow loop 20, which is generally co-extensive with an outer edge of loop 12.

The glow material in the segments 22 may preferably comprise an activated chemiluminescent product (ACP) containing a chemiluminescer and activator components, and including polyethylene, glass, chemiluminescer, and the activator. The glow material, commences glowing once exposed to light, and loses its effectiveness and ceases to glow after approximately 45 minutes. The glow ring may typically comprise three glow sticks or glow segments which are commercially available and are marketed in black packaging. It is necessary to maintain the glow sticks in a closed container or a black bag, in order to preserve the effectiveness of the glow material. For use, the glow sticks are removed from such sack or container, and are assembled together to provide a glow ring of a configuration to conform with the configuration of the throw device. After removal from their packaging, the sticks are then bent, snapped and shaked, thus to activate the glow material. They are then assembled to form the glow loop in the manner earlier described.

FIGS. 7 to 10 show various of the other configurations of devices according to the invention. These include the oval shape of FIG. 7, the configuration of FIG. 8 which has a visor extending from a loop according to Applicant's U.S. Pat. No. 6,260,208, the generally heart-shaped configuration of FIG. 9, and the generally triangular configuration of FIG. 10.

Figure 2:
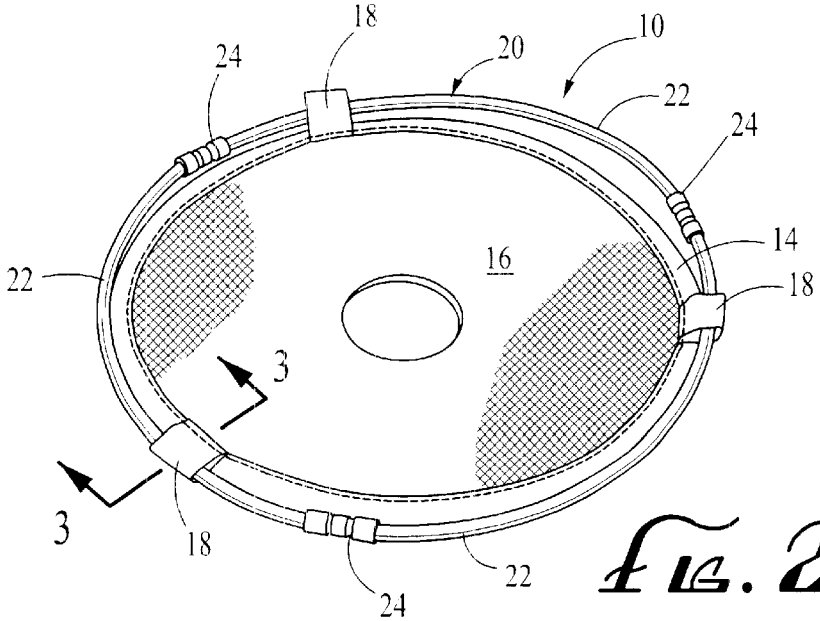
FIG. 2 is a perspective view of a device of the invention with glow ring segments shown.
Figure 3:
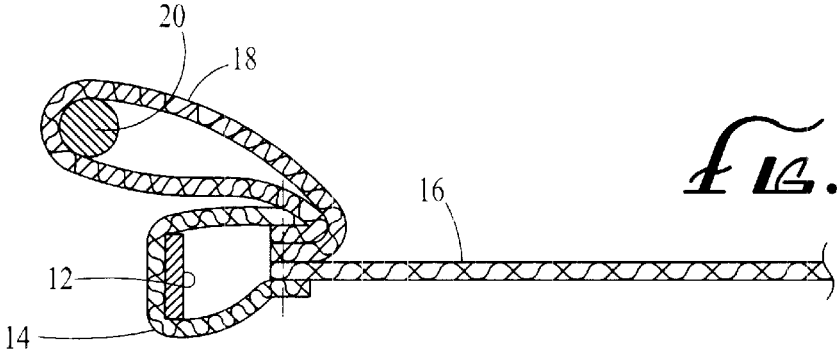
FIG. 3 is an enlarged sectional view taken at line 3—3 in FIG. 2.
Figure 4:
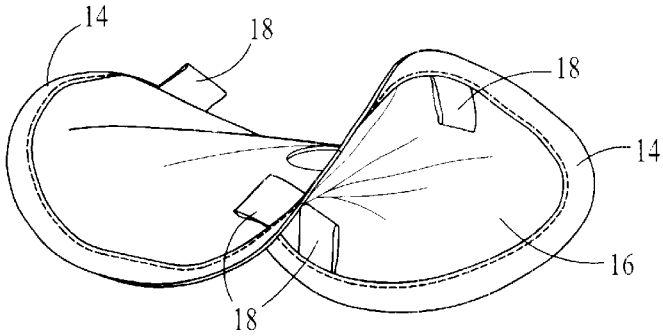
FIGS. 4 and 5 show the twisting of the device of FIGS. 1 and 2 into the compact configuration shown in FIG. 5.
Figure 9:
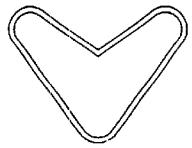
FIGS. 7 to 10 show other configurations of throw disks which may be utilized in embodiments of the present invention, these comprising an oval configuration, a configuration including a visor, a heart-shaped configuration, and a generally triangular configuration.
Figure 5:
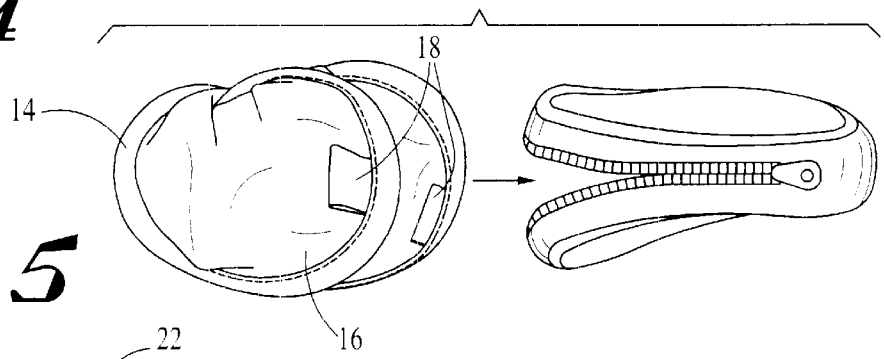
Figure 6:
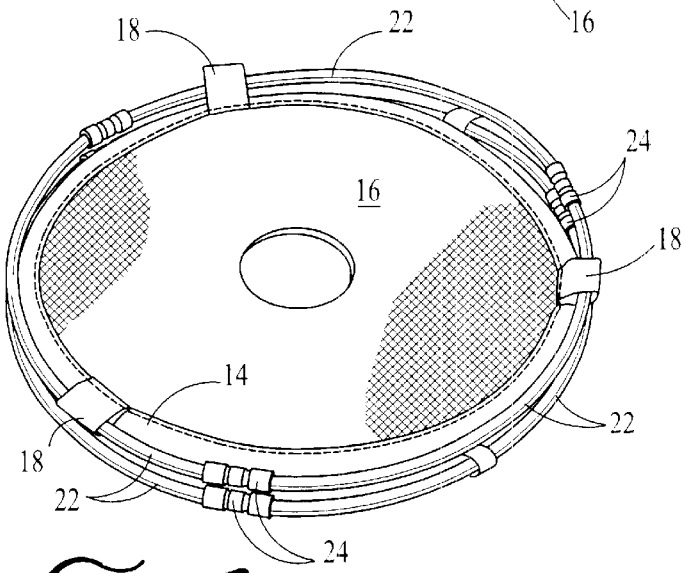
FIG. 6 is a perspective view of an embodiment of the invention wherein two glow rings are utilized.
Figure 10:
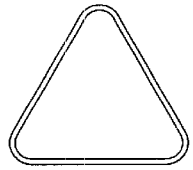
Figure 7:
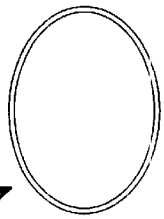
Figure 8:
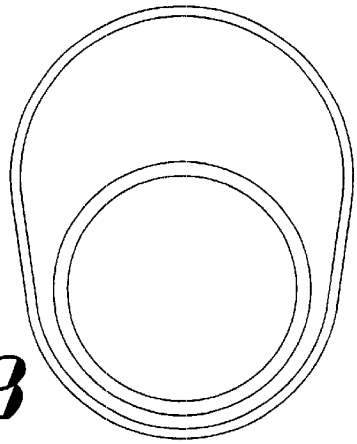

Devices according to the invention have the important advantage of being collapsible into a much smaller configuration for carrying, storage, etc. From the extended configuration shown in FIGS. 1, 2 and 5, the device is twistable into the configuration of FIG. 5 by manually grasping diametrically opposite sides thereof in the manner indicated in FIG. 4, and twisting the opposite sides toward each other, then folding the sides toward each other as indicated in FIG. 5, bringing the hands together to dispose the sides one above the other in layered configuration. The loops are thus overlaid or superimposed, the overlaid loops having a diameter of about one-third the diameter of the fully extended device. The device is thus readily disposed in a pocket, purse, etc. for carrying or storage, as indicated in FIG. 5 wherein the device is inserted into a compact carrying case.

It will be understood that various changes and modifications may be made from the preferred embodiments discussed above without departing from the scope of the present invention, which is established by the following claims and equivalents thereof.

The inventor claims:

1. A glowing throw device comprising:

a closed loop having a spring characteristic, a web attached about the loop and extending substantially thereacross, the loop is disposed in a peripheral hem of said web, and a glow ring attached about said loop to emit light when the device is tossed into the air.

2. A device according to claim 1, wherein the glow ring is substantially coextensive with the loop.

3. A device according to claim 1, wherein the glow ring is loosely attached to the loop.

4. A device according to claim 1, wherein the loop is formed of one of (a) spring steel, (b) appropriate spring plastic.

5. A device according to claim 1, wherein said web is formed of one of (a) synthetic fabric, (b) plastic-coated fabric, (c) plastic sheet, (d) stretch fabric, (e) textile.

6. A device according to claim 1, wherein said web has a central opening.

7. A device according to claim 1, wherein said loop has a configuration which is one of (a) circular, (b) oval, (c) triangular, (d) heart design configuration.

8. A device according to claim 1, and further comprising a second glow ring disposed about said closed loop and attached thereto.

9. A device according to claim 1, wherein said loop is deployable in its extended configuration, and is twistable into a compact layered array by grasping and twisting opposite side portions of the loop when held together to twist the loop into two generally symmetrical loops in overlaid or superimposed relation to facilitate carrying and storage in a compact container.

10. A glowing throw device comprising:

a closed loop having a spring characteristic, a web attached about the loop and extending substantially thereacross, a glow ring attached about said loop to emit light when the device is tossed into the air, and said glow ring comprising a plurality of inter-connected segments, each containing a glow material.

11. A device according to claim 10, wherein said segments are attached together by engagement in sockets in end portions of adjacent segments.

12. A device according to claim 10, wherein said glow material comprises an activated chemiluminescent containing a chemiluminescer and activator components.

13. A glowing throw device comprising:

a closed loop having a spring characteristic, a web attached about the loop and extending substantially thereacross, a glow ring attached about said loop to emit light when the device is tossed into the air, and a plurality of flexible rings through which the glow ring extends to loosely attach the glow ring to said loop.

14. A device according to claim 13, wherein said flexible rings are secured at a hem of said web and loosely retain the glow ring about the periphery of the loop.

15. A device according to claim 13, wherein the glow ring is substantially coextensive with the loop.

16. A device according to claim 13, wherein the loop is disposed in a peripheral hem of said web.

17. A device according to claim 13, wherein the loop is formed of one of (a) spring steel, (b) appropriate spring plastic.

18. A device according to claim 13, wherein said web is formed of one of (a) synthetic fabric, (b) plastic-coated fabric, (c) plastic sheet, (d) stretch fabric, (e) textile.

19. A device according to claim 13, wherein said loop has a configuration which is one of (a) circular, (b) oval, (c) triangular, (d) heart design configuration.

20. A device according to claim 13, wherein said glow ring comprises a plurality of inter-connected segments, each containing a glow material.

21. A device according to claim 20, wherein said segments are attached together by engagement in sockets in end portions of adjacent segments.

22. A device according to claim 20, wherein said glow material comprises an activated ehemiluminescent containing a chemiluminescer and activator components.

23. A device according to claim 1, and further comprising a second glow ring disposed about said closed loop and attached thereto.

24. A device according to claim 13, wherein said loop is deployable in its extended configuration, and is twistable into a compact layered array by grasping and twisting opposite side portions of the loop when held together to twist the loop into two generally symmetrical loops in overlaid or superimposed relation to facilitate carrying and storage in a compact container.

* * * * *